United States Patent [19]

Henrich

[11] Patent Number: 4,580,399

[45] Date of Patent: Apr. 8, 1986

[54] PROCESS FOR FURTHER PROCESSING A WIRE WOUND BY A FLYER

[76] Inventor: Werner Henrich, Am Wachtgipfel, D-6349 Hörbach, Fed. Rep. of Germany

[21] Appl. No.: 544,236

[22] Filed: Oct. 21, 1983

[30] Foreign Application Priority Data

Oct. 21, 1982 [DE] Fed. Rep. of Germany ..... 32389485
Jun. 3, 1983 [DE] Fed. Rep. of Germany ..... 33202508

[51] Int. Cl.[4] ..... D07B 3/12; D07B 7/18

[52] U.S. Cl. ..... 57/59; 57/1 UN; 57/67; 57/352; 57/58.3

[58] Field of Search ..... 57/58.3, 58.32, 58.36, 57/58.38, 58.52, 58.65, 58.67, 58.72, 58.81, 58.83, 58.86, 59, 62–64, 70–72, 76, 1 UN, 2,3, 6, 9, 13, 14, 90, 352; 242/170, 171, DIG. 3

[56] References Cited

U.S. PATENT DOCUMENTS

| | | | |
|---|---|---|---|
| 1,911,925 | 5/1933 | Reed | 57/60 |
| 3,001,642 | 9/1961 | Hirst | 242/170 X |
| 3,309,857 | 3/1967 | Haugwitz | 57/58.36 X |
| 3,635,007 | 1/1972 | Yoshida et al. | 57/58.52 |
| 3,827,225 | 8/1974 | Schoerner | 57/58.34 X |
| 3,902,307 | 9/1975 | Schoerner | 57/58.3 X |
| 4,407,116 | 10/1983 | Henrich | 57/13 |

*Primary Examiner*—Donald Watkins
*Attorney, Agent, or Firm*—Edmund M. Jaskiewicz

[57] ABSTRACT

Wire which has been wound upon a spool or into a coil using a flyer which imparts a twist to the wound wire is unwound from the spool or coil by being withdrawn over an end of the spool or coil in a direction which neutralizes a twist and results in the unwound wire being twist-free.

20 Claims, 14 Drawing Figures

PROCESS FOR FURTHER PROCESSING A WIRE WOUND BY A FLYER

The present invention relates to the processing of wire, rope, single strand cable, multiple strand cable or the like, more particularly, to the unwinding of wire from a coil or spool upon which the wire was wound using a flyer.

In winding a wire with the use of a flyer, the wire is supplied in the direction of the axis of the spool into the winding device and then guided upon the spool by means of rollers so that the wire is tangentially positioned on the core of the spool. In such a process, the wire is given a twist in the magnitude of 360° with respect to each flyer revolution.

The wire is supplied tangentially to the spool and is wound directly onto the core of the spool. In such a winding apparatus, the spool is rotating. In the event it is desired to subject the wire to a further process, the wire is unwound from the spool in a tangential feed from the core of the spool and the spool is again being rotated. The wire is not twisted in this process.

While it is desirable to carry out a continuous operation in the further processing of wire wherein very large quantities of wire are to be processed, it is a disadvantage or drawback if the process must be interrupted when the wire being supplied from the spool has been completely removed from the spool. At this stage, the end of the wire of the empty spool must be connected or joined with the beginning of the wire of the succeeding full spool. If it is desired to reduce or decrease this process of connecting wires and to minimize the loss of time involved, it is then necessary to use very large spools carrying very long wires. However, such spools are extremely heavy and are very difficult and expensive to handle. Further, since these heavy spools continue to rotate while the wire is being unwound from them, special brake devices must be provided for the spools so that the stress on the wire is maintained constant while the wire is being unwound. These disadvantages of winding and unwinding the wire onto a spool or from a spool are avoided if the wire is unwound over an end of the spool since in this situation both spools remain stationary for winding and unwinding. In such a process the wire is subjected to only slight stresses.

In addition, the end of the wire of one spool can be easily connected with the beginning of the wire of the next succeeding full spool without interrupting the operation of the further processing to which the wire is being subjected.

The same problem also occurs when a cable which was initially wound upon a spool or in a coil with the help of a flyer is now to be unwound from the end of the spool or coil to be positioned in a trench dug in the ground. During the laying of the cable in the ground, the cable, because of the twist originally imparted therein during the winding with a flyer has a tendency to form undesirable coils or kinks therein. According to DE-OS No. 31 02 101, it has been proposed to eliminate this problem by running the cable through a straightening device after the cable has been unwound from the spool or coil. While this straightening device does not completely counter-balance the twist in the cable, it does straighten out the coils which are caused by the twist so that the cable can be layed in a straight line.

The presence of twist in the wire is particularly noticeable if a number of individual strands or wires are wound simultaneously on the spool by means of a flyer and these wires are then to be varnished or insulated after being unwound for subsequent stranding into a telephone cable or the like. The individual wires or strands must be separated from each other after being unwound from the spool. But this is extremely difficult and sometimes impossible if the wires have already been "stranded" or twisted during the unwinding process.

It is therefore the principal object of the present invention to provide a novel and improved process for unwinding of wire from a spool or coil.

It is a further object of the present invention to provide a process for the unwinding of wire from a spool or coil wherein the wire was twisted during winding thereof upon the spool or coil.

It is an additional object of the present invention to provide a process wherein a wire or cable consisting of several individual strands or wires can be unwound from a spool or coil so as to neutralize or remove any twisting of the wires which may have occurred during winding upon the spool or coil.

According to one aspect of the present invention, a wire or cable which is to be subjected to further processing and which was wound in a coil or on a spool by means of a flyer is unwound over an end of the coil or spool in a substantially axial direction with respect to the coil or spool and the unwound wire is withdrawn in a substantially axial direction such that any twisting which may have occurred in the wire during winding is reversed, and the untwisted wire can then be subjected to further processing.

If the wire is unwound over the end of a coil or spool from the outside windings, then the wire is given an unwinding direction that is in the direction of the original direction from which the wire was supplied. If the wires were unwound in the extension of the original supply direction, the twist would be increased.

If the wire is unwound from the interior of a coil in which the interior of the coil is provided with a conical cavity or space, then the wire is to be unwound in an extension of the supply direction to compensate for the twist imparted upon the wire.

Since it is frequently advantageous for technological reasons relating to the process to wind the wire using a flyer on a vertically-positioned spool having a conical core wherein the greater core diameter during winding is at the top. It is then preferable to unwind the wire after removal of the core by beginning the unwinding from the interior of the coil at the larger opening because this operation avoids any necessity for turning the heavy spool around. However, in these circumstances the wire will retain its twist. However, according to the present invention, the twist can be reversed if after such an unwinding the wire is brought back downwardly through the interior of the coil. The wire once again is twist-free when it leaves the coil.

In order to create such a cavity in the coil, the wire can be wound using a flyer upon a conical core which is known in the art, and the core is subsequently removed when it is desired to unwind the wire.

Overend winding is especially noticeably favorable in the case of tubular or cage stranding devices, in which several coils or spools full of wire are placed behind one another looking in the stranding direction and in which the individual wires coming from the coils or spools are brought together in the stranding point. In these devices the spools can be arranged in a stationary manner according to the invention, so that, in contrast to the state of art, no large masses need to be moved in stranding. The unwinding direction for the wire can run parallel to the axis of rotation of the stranding device. But it can also be perpendicular to it or it can be inclined at an angle to the stranding direction. Costly brake devices for the rotatable spool previously included in such an arrangement are no longer required. It suffices suitably to brake merely one guide roller assigned to each wire to have the wire enter the stranding point with the necessary stress.

The invention is particularly advantageous in the case of a stranding machine in which a multiplicity of wires are to be wound around a core wire in multi-layers. This winding is to be done in an orderly manner. In particular, no loops are to be formed while stranding the individual wires. This can happen if the stranding process is carried out at great speed because the individually fed wires then frequently take on different speeds. The electric characteristics of litz wire is unfavorably affected over its length in a disorderly stranded litz wire. Moreover, disorderly stranded wires require more insulating material. Since insulating material is obtained from crude oil, disorder stranding of the wires makes the production process of electric cable more expensive in terms of material.

Therefore, the object is to carry out the stranding of the individual wires quickly and orderly.

The invention solves this problem by arranging the wires required for a layer, or at least part of the wires required for a layer, in a twisted form on a spool and by so unwinding them from the spool that the wires are untwisted, so that they can then be stranded into a litz wire. Different speeds of the wires of one layer cannot occur even in rapid stranding of the wires, for example, with the aid of a rotating flyer. In this case the flyer, for example, may rotate at 2000 rpm. To attain a desired length of twist in stranding, the spool on which the litz wire is wound will be kept running at a higher speed than the flyer speed, for example, at an additional 100–150 rpm.

Other objects and advantages of the present invention will be apparent upon reference to the accompanying description when taken in conjunction with the following drawings, which are exemplary, in which.

Proceeding next to the drawings wherein like reference symbols indicate the same parts throughout the various views, a specific embodiment of the present invention will be described in detail.

Figure 1:
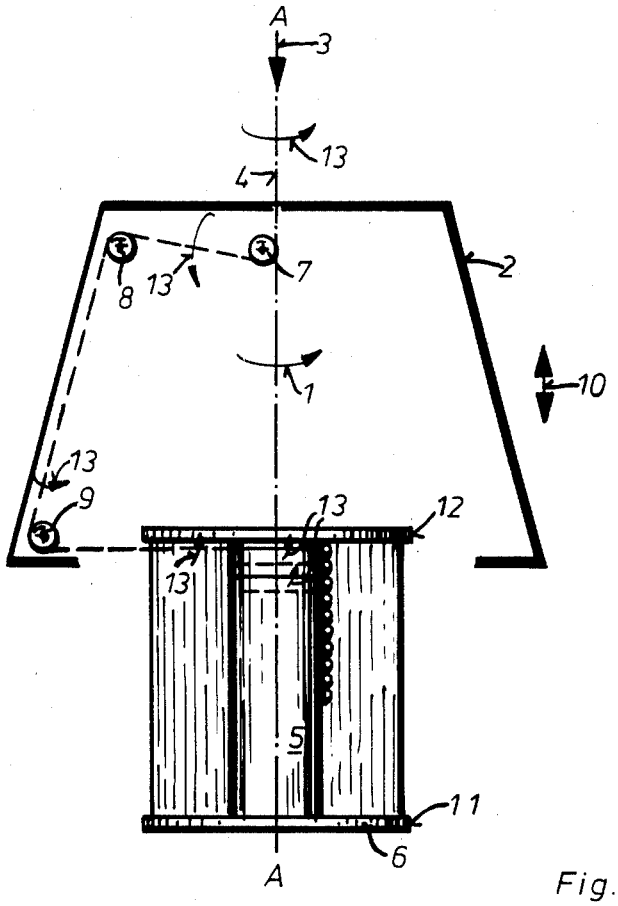
FIG. 1 shows diagramatically the process of winding a wire upon a spool using a flyer.

As may be seen in FIG. 1, a wire 4 supplied in the direction of arrow 3 is wound around the core 5 of a spool 6 with the aid of a flyer 2 rotating around the axis A-A. The wire 4 is fed over guide rollers 7, 8 and 9 so that the wire is laid in a tangential direction on the core 5 of the spool. The flyer 2 reciprocates in the directions of the double ended arrow 10 so that the wire is layed uniformly between the flanges 11 and 12 of the spool.

As a result of the rollers 8 and 9 which rotate around the axis A—A in the direction of arrow 1, the wire 4 is twisted in the direction of arrow 13. The wire, which contains this twist, is then laid layer by layer on the core 5 of spool 6.

Figure 2:
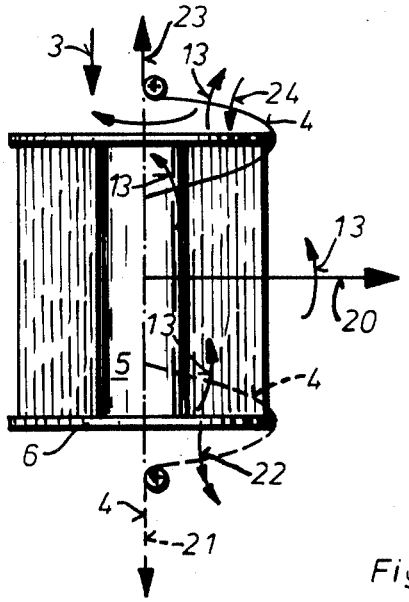
FIG. 2 shows diagramatically the unwinding of a wire from a spool according to the present invention.

If, for further processing, the wire is unwound from the outer layers of the spool in the direction of the arrow 20 as seen in FIG. 2, the wire will retain its original twist and this twist is not always desirable when the wire is being subjected to further processing.

If the wire 4 is unwound from the outside of the spool in the direction of dot-dash line 21, then an additional twist is imparted to the wire as indicated by the double arrow 22. Unwinding direction 21 is an extension of supply direction 3.

However, if the wire 4 is unwound from the spool from the outside in the direction of arrow 23, then an unwinding twist as indicated by arrow 24 is superimposed on the winding twist indicated by arrow 14. Both twists thus neutralize each other. As a result, the wire 4 is unwound from spool 6 in direction 23 without any twist. In this situation, unwinding direction 21 must run opposite to or the reverse of the supply or feed direction 3.

Unwinding of the wire from the spool can be accomplished with an unwinding device, such as for example, with the aid of a flyer-like roller system that is rotated in the direction opposite to that of flyer 2 in FIG. 1 and which withdraws the wire in the correct direction as shown in FIG. 2.

Figure 3:
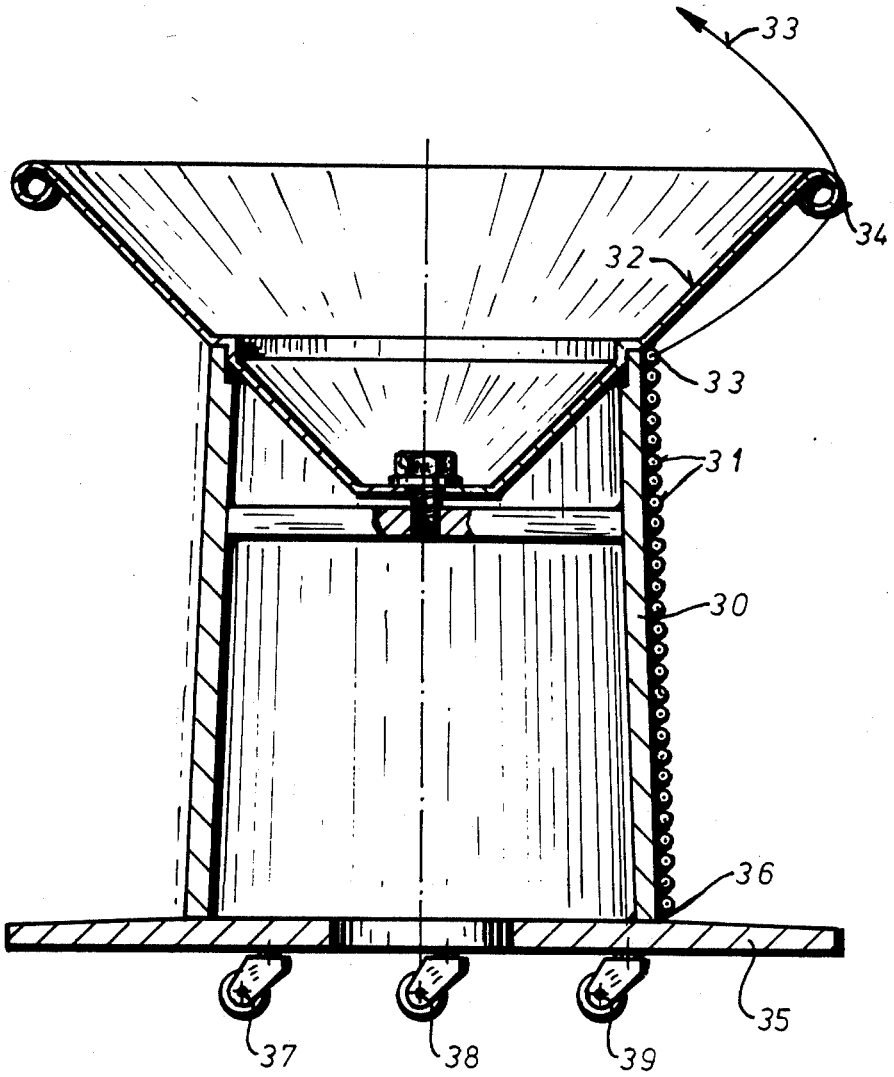
FIG. 3 is an axial sectional view of a spool which is preferably used in the present invention.

In FIG. 3 there is illustrated a spool which can be advantageously used with the present process. This spool has a core 30 which is slightly conically shaped as illustrated so that the layers of wire 31 will be positioned conically on the core 30. The spool has an upper flange 32 which is conical so that wire 33 being unwound from this spool can readily be unwound from the corners or intersections between the spool flange and core. To facilitate pulling of the wire over the edge of spool flange 32 the edge of the flange is constructed as an unwinding ring 34. The lower spool flange 35 also forms an obtuse angle with core 30 so that wire can be easily pulled from the corner or intersection indicated at 36. Since a spool constructed as shown in FIG. 3 can be very large, it is apparent that a fully loaded spool would be extremely heavy. To facilitate handling of such a spool, rollers 37, 38 and 39 can be provided which are attached to the lower flange 35.

Figure 4:
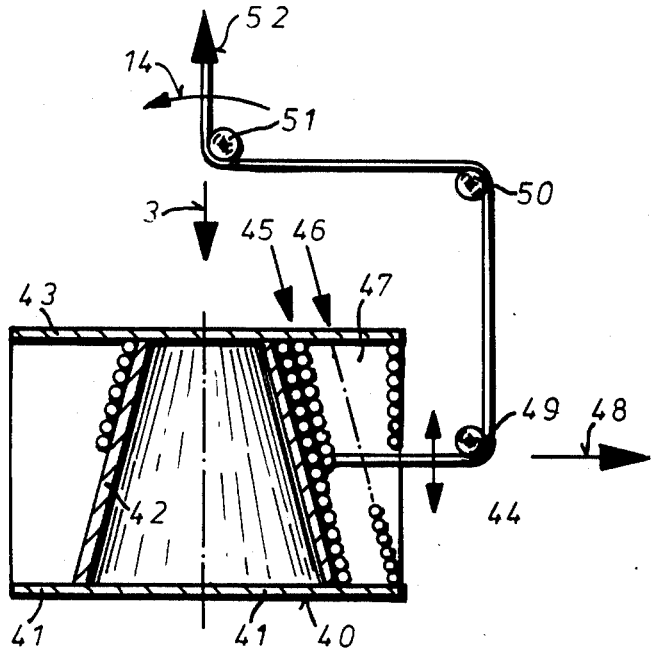
FIG. 4 is a diagramatic representation of unwinding a wire according to a modification of the present invention.

In FIG. 4, there is shown a spool 40 having a strongly inclined conical core 42 on which layers of wire 45, 46 are wound with a corresponding degree of conicity. The space 47 indicated between spool flanges 41 and 43 is also covered with conically lined layers of wire but in this space, layers of wire are shorter so as to maintain an outer cylindrical form of the coil. The wire has been wound on spool 40 in supply direction 3 with the aid of flyer 2 as shown in FIG. 1.

If the wire is unwound in the direction of arrow 48, the wire will retain its twist. However, if the wire is unwound with the aid of rollers 49, 50, 51 rotating in the direction of arrow 14, the wire withdrawn in the in the direction of arrow 52 will be free of twist.

In FIG. 5, the wire is again supplied in the feed direction 3 and wound with the aid of a flyer in conical layers on a spool 52 similar to that of FIG. 4 but the large core diameter is at the bottom. In order to unwind the wire, the spool was turned around so that the spool assumes the position shown in FIG. 5 with the larger core diameter on the top or directed upwardly. The spool flange which is normally on the top side of the spool has been removed for the process of unwinding the wire and thus is not illustrated. Further, the core 53 is constructed to be detachable from spool 52 in the direction of arrow 54 or at least as movable in the direction of arrow 54 with the aid of a bellows structure 55 so that a space 57 is formed between core 53 and the innermost layer of wire 56. The wire is then unwound from the interior of the coil with its inner end 58 moving through the space 57 in the direction of arrow 59. The withdrawing direction 59 is opposite to the supply direction 3 and the wire is thus free of any twist when leaving the coil.

Figure 5:
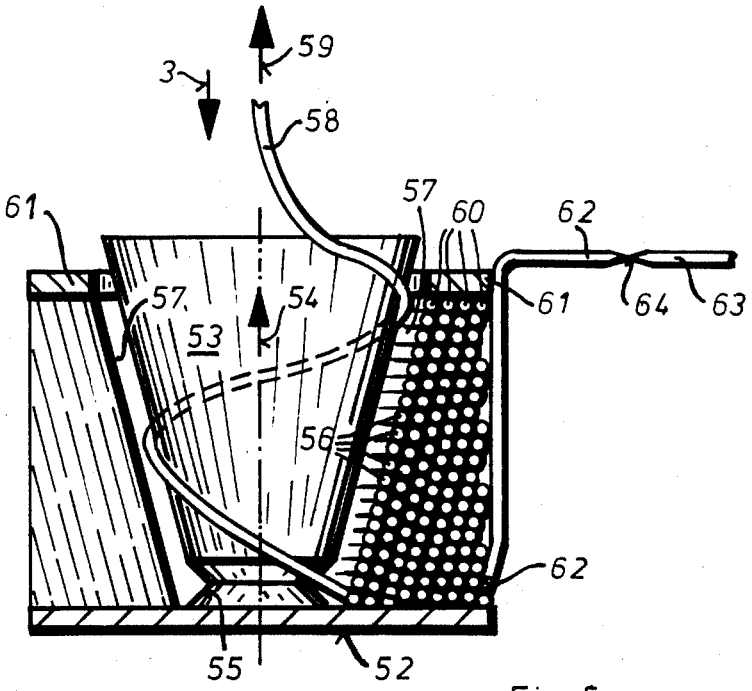
FIG. 5 is a diagramatic representation of another modification of the present process.

In many operations, it is desirable to avoid the turning around of a spool full of wire. In such situations, the wire may be then wound directly onto a spool as shown in FIG. 5 with the large core diameter directed upwardly. For twist-free unwinding, of the wire from the interior of the coil, the wire should then be pulled downwardly to the narrow opening of the coil. However, this is not desirable because there is the danger that the wire windings at least of the innermost layer of wire may slide into each other or may be pulled along downwardly. Therefore, as may be seen in FIG. 14, the wire of FIG. 5 is first pulled upwardly from the wider opening of the coil and then run over a roller 170 so that the wire moves downwardly through the coil in the direction of arrow 171. This unwinding of the wire produces a wire which is free of twist.

Figure 14:
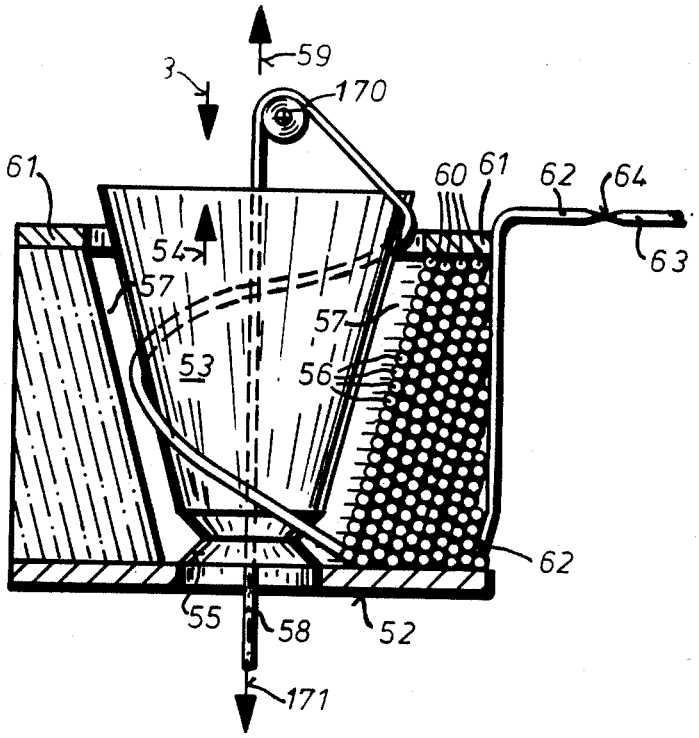
FIG. 14 is a diagramatic representation of a coil of wire being unwound according to a further modification of the present invention.

In order to prevent any pulling out of the upper layers of wire 60 when wire is unwound from the interior of the coil according to FIGS. 5 and 14, the upper layers 60 are preferably weighted down by a heavy plate 61.

It is apparent that during this process end 62 of the wire on the spool remains stationary during the unwinding process. Accordingly, the beginning of a wire 63 of a second coil or spool can be readily joined or connected with the wire end 62 at the connection 64 during a processing operation. It is therefore no longer necessary to interrupt the processing operation when the spool from which wire is being unwound becomes empty.

Figure 6:
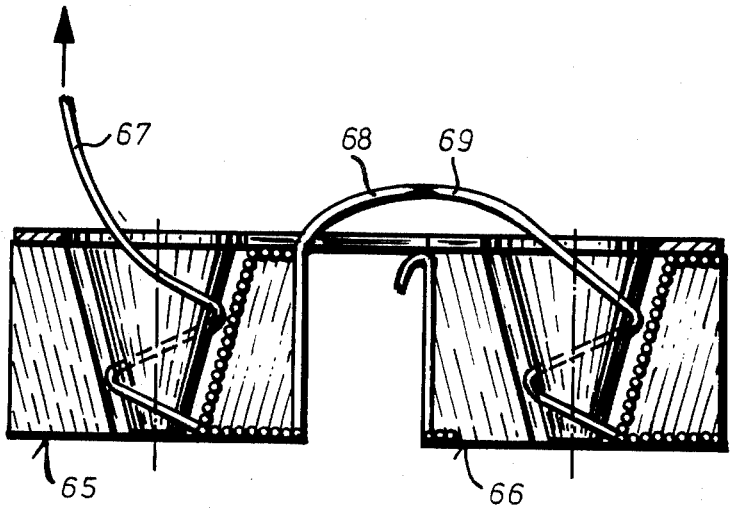
FIG. 6 shows diagramatically a still further modification of the process wherein the end of a wire from an empty spool is connected to the beginning of the wire on a full spool.

In FIG. 6, two coils 65 and 66, having conical cores are positioned side by side. The beginning of wire 67 of the coil 65 which is on the interior after the winding operation is now unwound from the coil 65 to subject the wire to further processing. The end 68 of the wire in coil 65 is connected with the beginning 69 of the wire in coil 66 as described in FIG. 5 so that when the wire of coil 65 has been completely unwound, the wire from coil 66 will begin to be unwound from the coil 66. In addition to coil 66, additional coils may be successively arranged and the ends and beginnings of the wires can be serially connected with one another ad infinitum.

Figure 7:
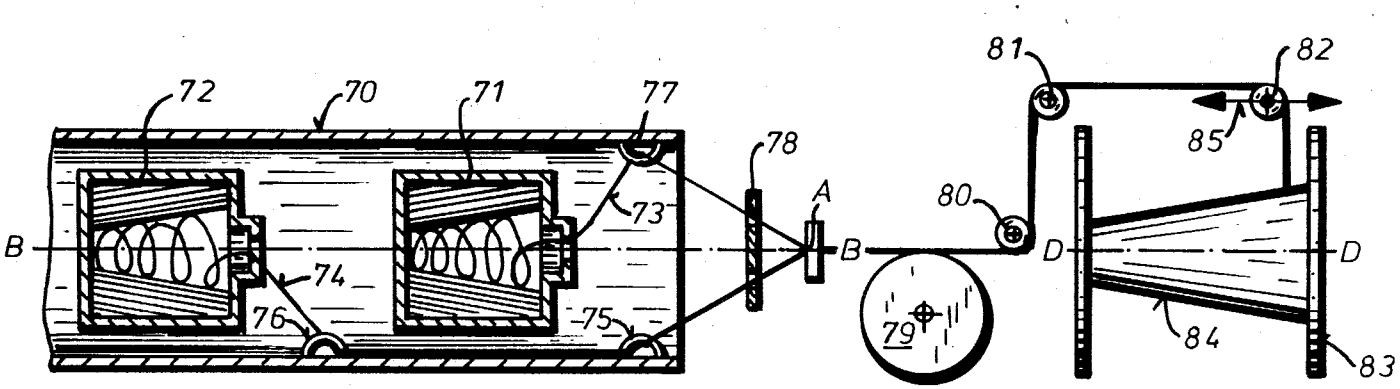
FIG. 7 is a longitudinal sectional view through a tubular stranding machine.

In the tubular stranding installation shown in FIG. 7, the tube 70 rotates around axis B—B and coil 71 and 72 are mounted in tandem within the tube 70. Additional coils which are not illustrated may also be connected in tandem within the tube and all of the coils are stationary and do not rotate with the tube 70.

Each of the coils has a conical core from which the wires can be unwound. The coils are so positioned that the unwinding direction for each coil is opposite to the supply direction during the winding process so that the wires are unwound from each coil in a twist-free condition. Wires 73, 74 pass through eyelets 75, 76 and 77 so they can follow the rotation of tube 70. The wires are then passed through respective openings in the rotary perforated disk 78 to a stranding point A where the stranding occurs. Unwinding of the wires from the coil is carried out by means of a drawing roller 79 around which the stranded wires are led. The wires so stranded can then be guided over guide rollers 80, 81 and 82 toward a spool 83 which rotates around axis D—D to enable the wire to be wound onto core 84. Roller 82 can be reciprocated in the directions of double arrow 85 to properly position the wire during the winding process upon core 84. In this tangential winding of the wire with its tangential feed, the wire is free of twist during winding. In place of the rotating spool 83, a flyer winding device according to that of FIG. 1 may be used. In further processing of the wire, consideration must then be given to unwinding the wire in a twist-free condition from spool 83 so that the wire is not wound up or given an additional twist.

Figure 8:
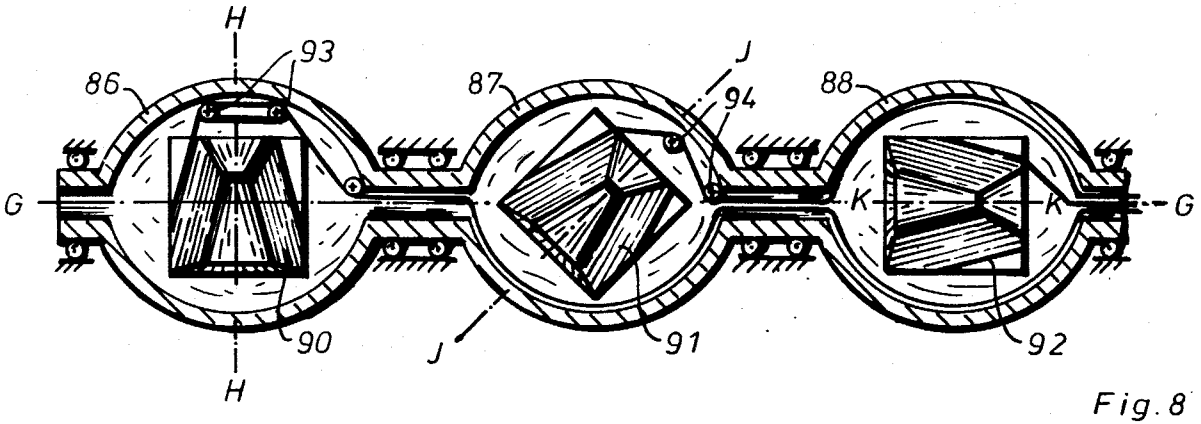
FIG. 8 is a longitudinal sectional view through a cage stranding machine.

In FIG. 8 there is shown a cage stranding machine which in principle operates in the same manner as the tubular stranding apparatus of FIG. 7. Coils 90, 91 and 92 are again mounted in a stationary condition so that they do not rotate with the stranding machine. Interconnected hoops or cages 86, 87 and 88 which enclose the coils rotate around axis G—G.

In the process according to FIG. 8, the wires are wound onto spools according to FIG. 3 in that they are pulled directly over the end of one spool flange each and again in the same direction so that the wires are free of twist. Every coil has had guide rollers 93 and 94 associated with it as may be seen in FIG. 8 and one of the rollers of each pair is braked in a manner known in the art as the wires come together at the stranding point with the required tension.

According to FIG. 8, the coils 90, 91 and 92 or the spools in the stranding apparatus can be disposed in any direction. By way of example, the coil 90 has its axis H—H positioned perpendicular to the stranding axis G—G. The coil 91 has its axis J—J inclined at an angle to the axis G—G and coil 92 has its axis K—K positioned coaxially to the axis of rotation G—G. The stranding process is then similar to that of the tubular stranding machine in FIG. 7.

Figure 9:
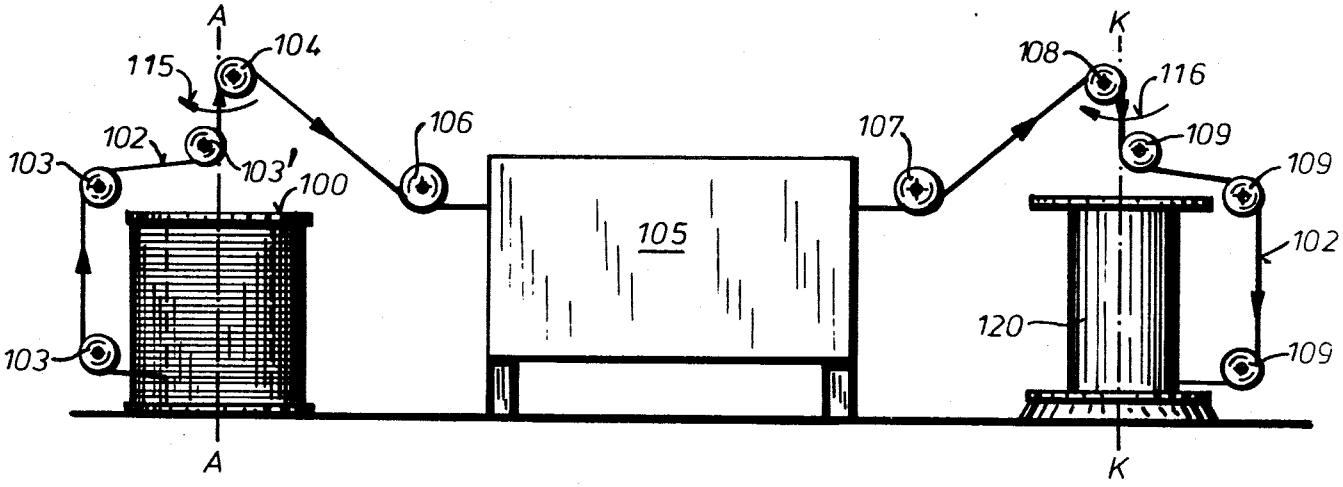
FIG. 9 is a side elevational view illustrating diagramatically the process of the present invention wherein a bundle of wires are unwound from a spool and subjected to a further processing.
Figure 10:
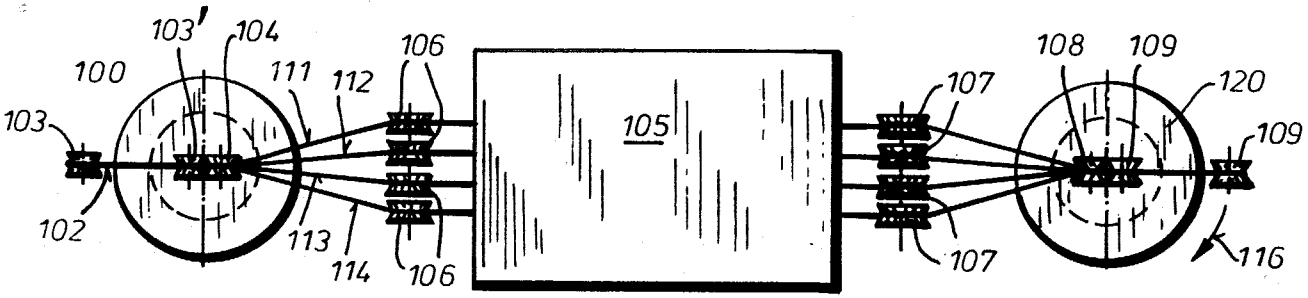
FIG. 10 is a top plan view of the apparatus represented in FIG. 9.

In FIGS. 9 and 10, spool 100 has been wound with the help of a flyer with a wire bundle or group 102 which consists of four individual strands 111, 112, 113 and 114. As a result, the wire bundle 102 has an inherent twist so that the individual strands form a rope-like strand or cable. With the use of flyer rollers 103, 103' rotating around the spool 100 in the direction of arrow 115, the wire bundle 102 is so unwound that the wire bundle is untwisted and the component strands of the wire bundle leave guide roller 104 as individual strands 111–114. The individual strands 111–114 are each then supplied to a respective guide roller 106 which guides them to a subsequent processing operation such as, for example, a varnishing 105. After leaving the varnishing installation 105, the individual strands pass over respective rollers 107 to a roller 108 and continue as parallel strands. With the help of a flyer 109 rotating around axis L—L in the direction of arrow 116, the wires are again wound onto spool 120 in a stranded condition.

According to the state of the art, this process is carried out so that the individual wire strands of the wire bundles were wound onto spool 100 lying parallel to each other. The spool 100 was positioned to rotate around axis A—A, so that the wire bundle 102 was supplied to roller 104 with the aid of the now stationary roller 103, 103' and subsequently separation of the wire bundle into individual strands occur.

Figure 11:
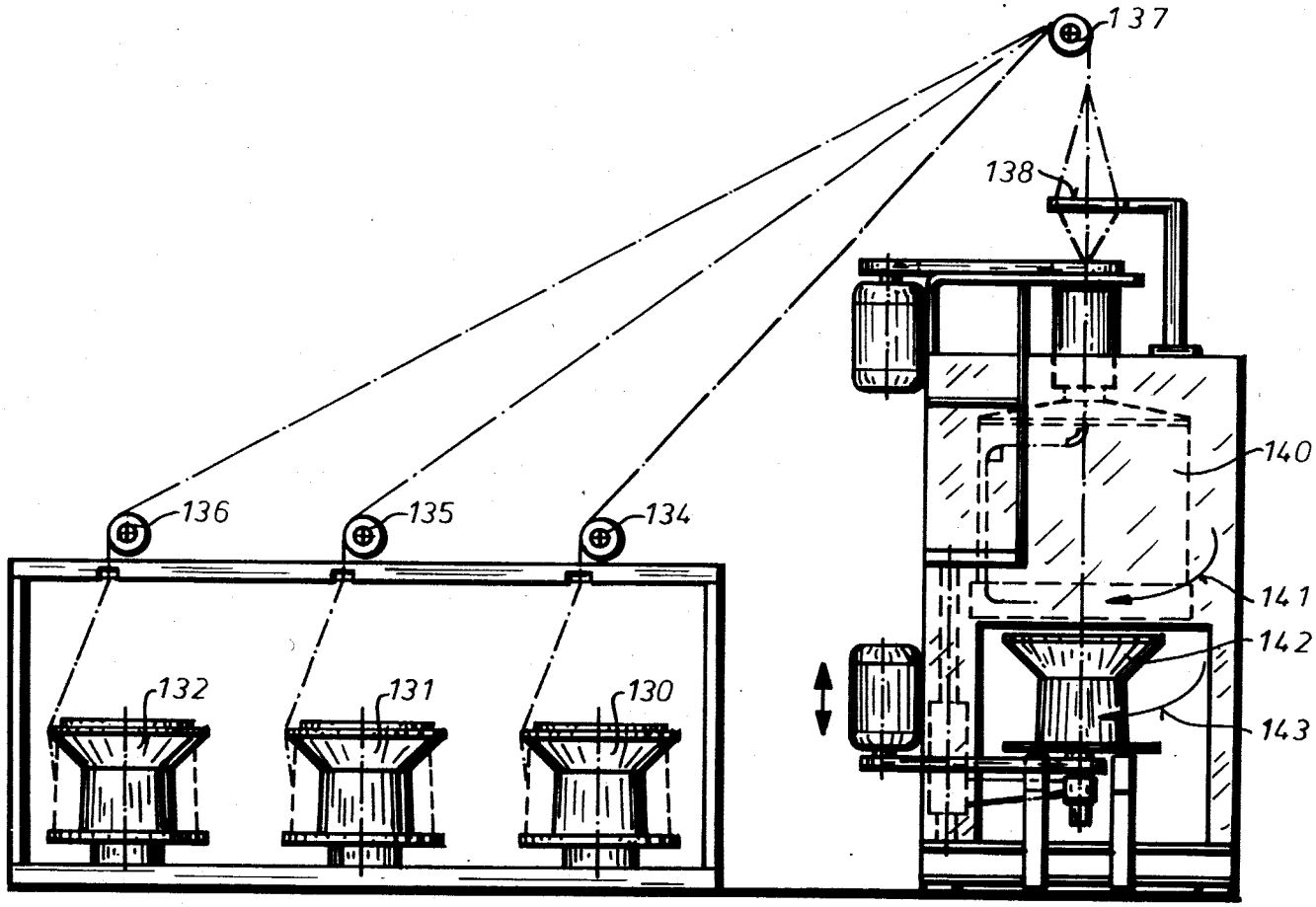
FIG. 11 is a side elevational view of a wire stranding machine.

In FIG. 11, a core wire is unwound from spool 130 and guided over rollers 134 and 137 through a centerhole 150 of a perforated disk 138 and then supplied to a flyer 140. A wire bundle which may consist, for example, of six wires, is unwound from a spool 131. The wire bundle is twisted within itself, for example, according to FIG. 1 by having been wound onto spool 131 with the aid of a flyer. The wire bundle of spool 131 is unwound so that the individual wire strands are untwisted and they can be guided separately over rollers 135 and 137 through holes 151 which are arranged in perforated plate 138 in a circle concentric to centerhole 150 through which the core wire is passing. From spool 132, a wire bundle which may consist of 12 wires which were also twisted during the winding operation is unwound. The unwinding direction is such that when the individual wire strands are running over guide rollers 136 and 137 they are untwisted so that these individual wires can pass through holes 152 of the perforated disk 138 and holes 152 are arranged in a circle concentric to the holes 151. The wires thus supplied to flyer 140 are twisted in respective layers during the rotation of the flyer so that the wires of spool 131 passing through holes 151 form a first layer around the core wire and the wires unwound from spool 132 and passing through holes 152 form a second layer around the first layer of wires.

The flyer 140 rotates in the direction of arrow 141 at a speed, for example, of 2000 r.p.m. Spool 142 rotates in the direction of arrow 143 which is the same direction as the flyer but at a speed of about 2118 r.p.m. so that spool 142 pulls the wires running over the guide rollers of guides of the flyer additionally and thus determines the length or pitch of the twist. The speed of the spool 142 additionally is controlled such that the winding speed of the litz wire or cable is maintained when spool 142 becomes full.

Figure 12:
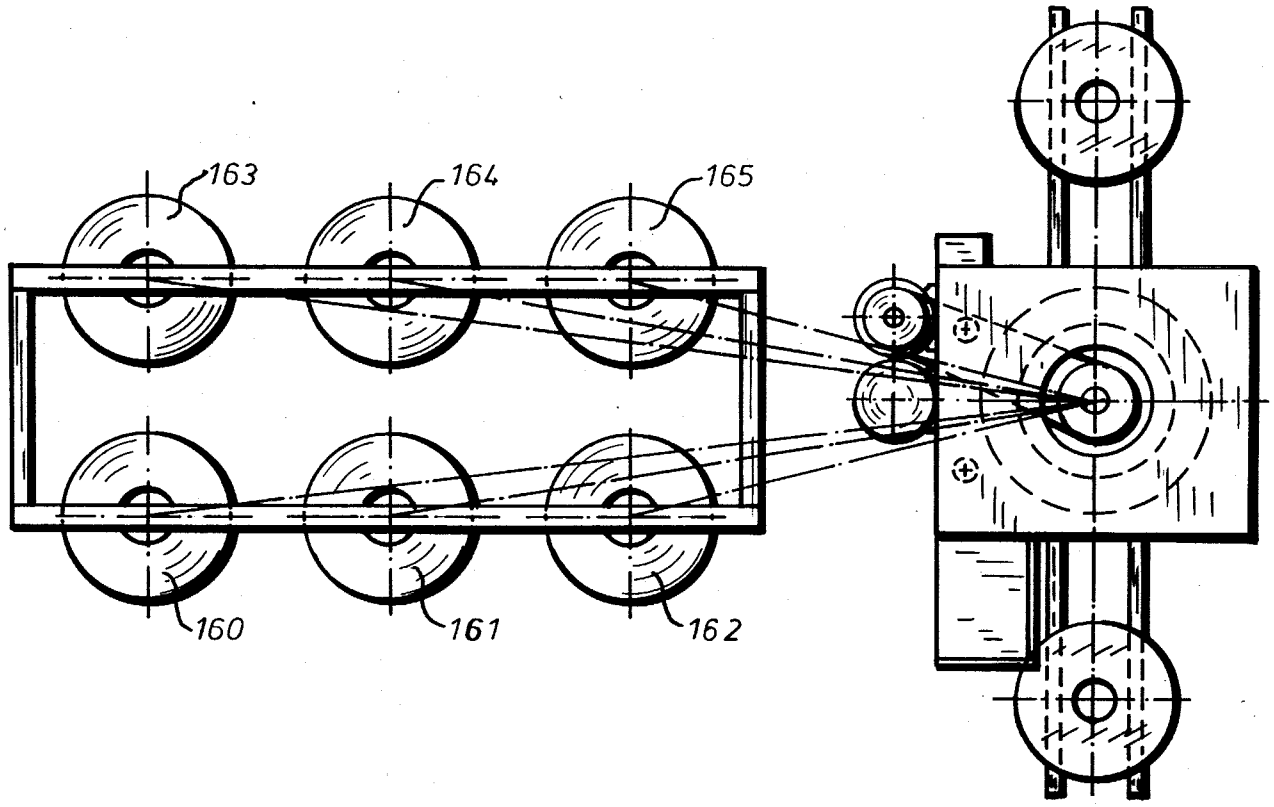
FIG. 12 is a top plan view of a wire stranding machine according to FIG. 11 and having a further modification.
Figure 13:
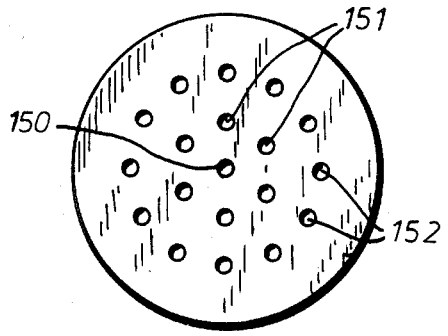
FIG. 13 is a plan view of the perporated plate used in the stranding machines of FIGS. 11 and 12.

In the top view of the apparatus, as shown in FIG. 12, six spools 160, 161, 162, 163, 164, 165 are employed from which wire bundles are unwound from each spool, and these bundles are then untwisted to be run to the perforated disk 138. One of the spools carries the core wire which is supplied as described above to the centerhole of the perforated disk.

Thus it can be seen that the present invention has disclosed an effective and economical process for the unwinding of wire from a spool or core upon which the wire was initially wound with a twist. The wire is unwound from the respective coil or spool in such a manner that the original twist is neutralized and the wire is supplied in a twist-free condition.

It will be understood that this invention is susceptible to modifications to adapt it to different usages and conditions and, accordingly, it is desired to comprehend such modifications within this invention as may fall within the scope of the appended claims.

What is claimed is:

1. In a process for subjecting to further processing a wire, rope, single strand cable, multiple strand cable or the like in which a twist was imparted when wound one of in a coil and on a spool by means of a flyer, the step of unwinding the wire over an end of the one coil or spool in a substantially axial direction with respect to the one coil or spool while maintaining the coil or spool stationary against rotation and withdrawing the unwound wire in a substantially axial direction such that the twist in the wire which occurred during winding is reversed and the untwisted wire can then be subjected to further processing.

2. In a process as claimed in claim 1 wherein the wire is unwound from the outside winding of a coil in a direction from which the wire was originally supplied to the coil.

3. In a process as claimed in claim 2, wherein the wire is unwound over an unwinding ring on the spool.

4. In a process as claimed in claim 3, wherein the unwinding ring is mounted on a flange of the spool.

5. In a process as claimed in claim 1 wherein the wire is unwound from the inside winding of a coil in a direction opposite to the direction in which wire was supplied to the coil.

6. In a process as claimed in claim 5 and the step of guiding the unwound wire in the reverse direction such that the wire is withdrawn in the same direction in which it was supplied to the coil.

7. In a process as claimed in claim 6 wherein the guided wire is passed through the interior of the coil.

8. In a process as claimed in claim 2 and the step of passing the unwound wire through a braking device.

9. In a process as claimed in claim 1 wherein the wire is disposed in conical layers in one of a coil or a spool.

10. In a process as claimed in claim 1 wherein the wire is wound upon a spool having a conical core.

11. In a process as claimed in claim 10 wherein a flange of the spool is conical and tapering in a direction opposite to the taper in said core.

12. In a process as claimed in claim 11 wherein the flange on the end of the spool from which the wire is unwound is detachable from the core.

13. In a process as claimed in claim 1 wherein a plurality of coils or spools are disposed in tandem within a rotatable cage of a stranding apparatus and the wires unwound from the respective spools or coils are joined at a stranding point, the coil or spools being stationary.

14. In a process as claimed in claim 13 wherein the coils or spools have their axes perpendicular to or inclined at an angle to an axis of rotation of the stranding apparatus.

15. In a process as claimed in claim 13 wherein each wire unwound from a respective coil or spool is passed over a braked roller.

16. In a process as claimed in claim 1 wherein the wire comprises a plurality of individual strands, and separating the individual strands during the unwinding of the wire from a coil or spool.

17. In a process as claimed in claim 16, wherein a plurality of wires each comprises a plurality of individual strands and each wire is wound in a twisted form upon a spool, unwinding the wires from the respective spools such that the wires are untwisted, separating the individual strands of each wire and passing the individual strands through perforations in a disk, and passing the individual strands to a flyer which lines and twists the individual strands in a multi-layer manner onto a second spool.

18. In a process as claimed in claim 17 wherein the perforations are disposed in concentric circles around a centerhole in the disk.

19. In a process as claimed in claim 17, and the step of rotating the second spool in the same direction of rotation as the flyer and at a speed greater than that of the flyer.

20. In a process as claimed in claim 19 and the step of removing the spool laterally after one of lifting the flyer or lowering the spool.

* * * * *